US008840341B2

(12) United States Patent
Nelson et al.

(10) Patent No.: US 8,840,341 B2
(45) Date of Patent: Sep. 23, 2014

(54) CONNECTION SYSTEM AND METHOD FOR MECHANICALLY STABILIZED EARTH WALL

(75) Inventors: Guy C. Nelson, Byron Center, MI (US); John M. Ogorchock, Montgomery, TX (US); Peter M. Sevick, Tomball, TX (US)

(73) Assignee: Tricon Precast, Ltd., Houston, TX (US)

( * ) Notice: Subject to any disclaimer, the term of this patent is extended or adjusted under 35 U.S.C. 154(b) by 0 days.

(21) Appl. No.: 13/317,714

(22) Filed: Oct. 26, 2011
(Under 37 CFR 1.47)

(65) Prior Publication Data

US 2013/0142577 A1 Jun. 6, 2013

Related U.S. Application Data

(60) Provisional application No. 61/455,825, filed on Oct. 27, 2010.

(51) Int. Cl.
*E02D 29/02* (2006.01)

(52) U.S. Cl.
USPC ..... 405/262; 405/286

(58) Field of Classification Search
USPC ..... 405/262, 284, 285, 286
See application file for complete search history.

(56) References Cited

U.S. PATENT DOCUMENTS 4,068,482 A 1/1978 Hilfiker
4,117,686 A 10/1978 Hilfiker
4,154,554 A 5/1979 Hilfiker
4,260,296 A 4/1981 Hilfiker
4,266,890 A 5/1981 Hilfiker
4,324,508 A * 4/1982 Hilfiker et al. ..... 405/284
4,329,089 A 5/1982 Hilfiker
4,343,572 A 8/1982 Hilfiker
4,391,557 A 7/1983 Hilfiker
4,505,621 A 3/1985 Hilfiker
4,529,174 A 7/1985 Pickett
4,616,959 A 10/1986 Hilfiker
4,653,962 A 3/1987 McKittrick et al.
4,661,023 A 4/1987 Hilfiker
4,668,958 A 5/1987 Keiser
4,684,287 A 8/1987 Wojchiechowski
4,834,584 A 5/1989 Hilfiker
4,856,939 A 8/1989 Hilfiker
4,874,272 A 10/1989 Egan
4,904,124 A 2/1990 Egan
4,929,125 A * 5/1990 Hilfiker ..... 405/262
4,945,362 A 7/1990 Keiser
4,952,098 A * 8/1990 Grayson et al. ..... 405/262
4,961,673 A 10/1990 Pagnano et al.
4,993,879 A * 2/1991 Hilfiker ..... 405/262
5,044,833 A * 9/1991 Wilfiker ..... 405/262
5,131,791 A * 7/1992 Kitziller ..... 405/286
D336,341 S 6/1993 Van Steenlandt
5,259,704 A * 11/1993 Orgorchock ..... 405/262

(Continued)

*Primary Examiner* — Frederick L Lagman
(74) *Attorney, Agent, or Firm* — C. Dale Quisenberry

(57) ABSTRACT

A crimped connection system and methods for use in connection with the construction of earth walls is disclosed. A grid-type soil mat may be provided with a number of crimped ends. The crimped ends may be adapted for engagement through the use of a locking member with another soil mat or with a plurality of anchors partially embedded within a precast concrete panel. The plurality of anchors may be formed as part of a gang or unitary structure to facilitate alignment of the anchors when being cast into the precast concrete panels.

9 Claims, 10 Drawing Sheets

(56) References Cited

U.S. PATENT DOCUMENTS

| | | | | |
|---|---|---|---|---|
| 5,308,195 | A | 5/1994 | Hotek | |
| 5,316,465 | A | 5/1994 | Hummel | |
| 5,335,815 | A | 8/1994 | Josselyn | |
| 5,467,567 | A | 11/1995 | Christensen | |
| 5,494,379 | A | 2/1996 | Anderson et al. | |
| 5,539,163 | A | 7/1996 | Anderson et al. | |
| 5,540,027 | A | 7/1996 | Christensen et al. | |
| 5,722,799 | A | 3/1998 | Hilfiker | |
| 5,807,030 | A | 9/1998 | Anderson et al. | |
| 5,975,810 | A * | 11/1999 | Taylor et al. | 405/262 |
| 6,048,138 | A | 4/2000 | Lamberson et al. | |
| 6,186,703 | B1 * | 2/2001 | Shaw | 405/262 |
| 6,793,436 | B1 * | 9/2004 | Ruel et al. | 405/262 |
| 6,802,675 | B2 | 10/2004 | Timmons et al. | |
| 6,860,681 | B2 * | 3/2005 | Ruel | 405/262 |
| 6,939,087 | B2 * | 9/2005 | Ruel | 405/262 |
| 2004/0179902 | A1 * | 9/2004 | Ruel | 405/284 |
| 2009/0285639 | A1 * | 11/2009 | Taylor et al. | 405/262 |

* cited by examiner

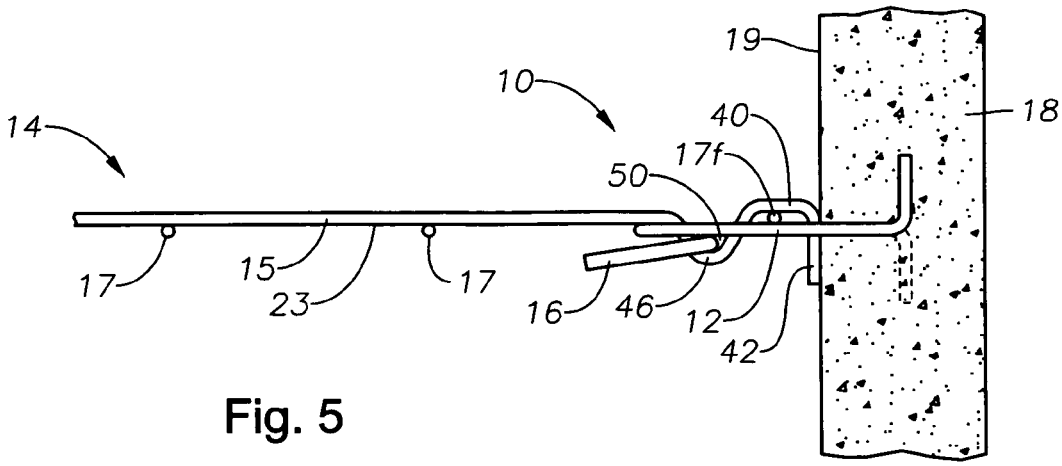
Fig. 5
Fig. 6
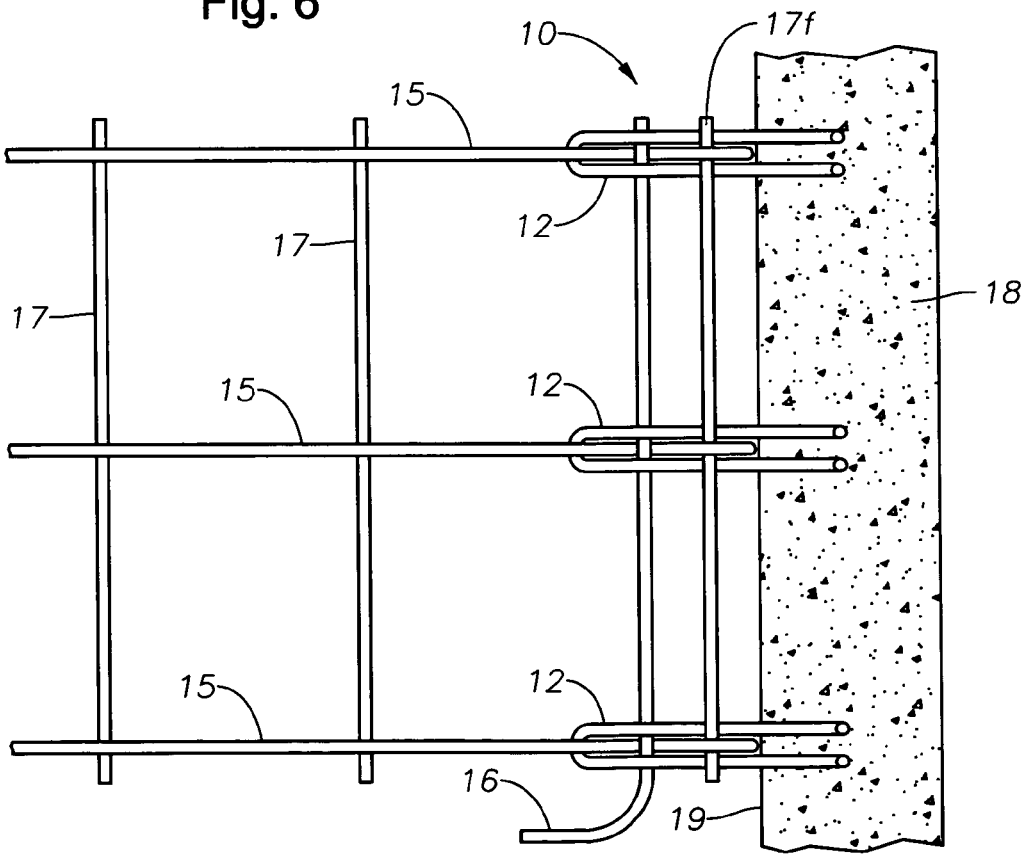

Fig. 10
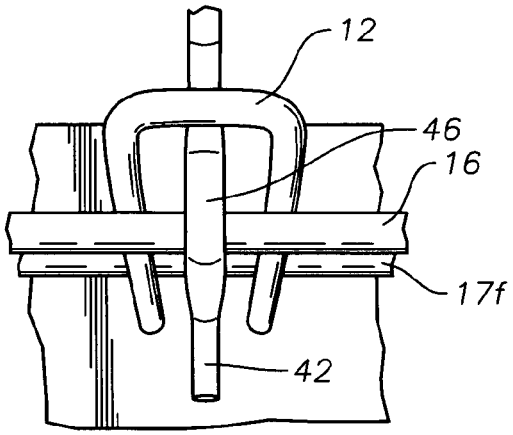
Fig. 11
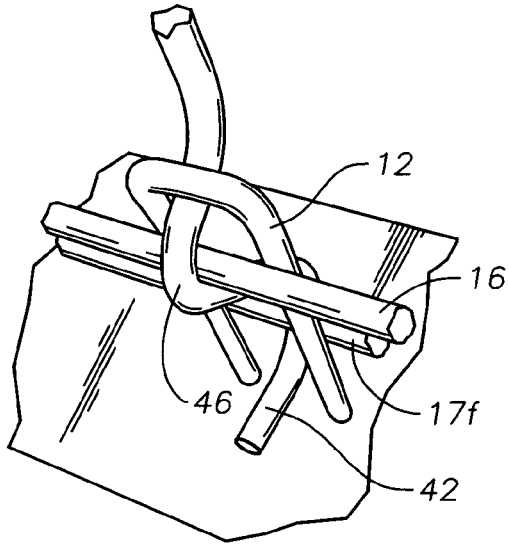
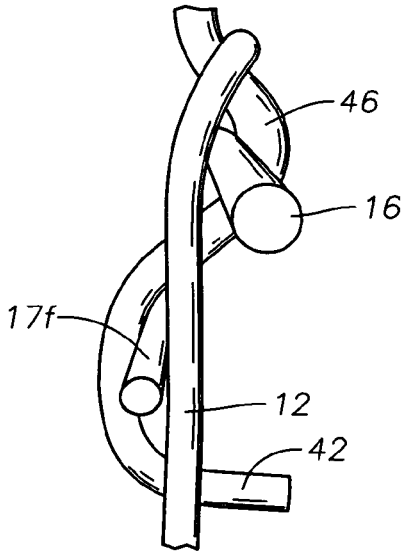
Fig. 12

CONNECTION SYSTEM AND METHOD FOR MECHANICALLY STABILIZED EARTH WALL

RELATED APPLICATIONS

This application claims the benefit to U.S. Provisional Patent Application Ser. No. 61/455,825, filed on Oct. 27, 2010, the contents of which are fully incorporated herein by reference.

BACKGROUND OF THE INVENTION

1. Field of the Invention

The present invention generally pertains to retaining walls for use in the road construction industry, and more particularly to improved connection systems and related methods for use with mechanically stabilized earth walls.

2. Description of the Related Art

It is known within a variety of fields to construct retaining walls for various purposes. Within the road construction industry, for example, it is known to erect temporary and permanent retaining walls for embankments, roadway supports, bridge abutments and the like. It is also known that these retaining walls can be constructed using a variety of techniques and materials, including, for example, concrete and/or welded wire components. An example of a precast modular wall panel is disclosed in U.S. Pat. No. 5,259,704 to Ogorchock. Examples of retaining walls constructed using welded wire components may be found in a number of U.S. patents, including, for example, U.S. Pat. No. 4,117,686 to Hilfiker, U.S. Pat. No. 4,329,089 to Hilfiker et al., U.S. Pat. No. 4,391,557 to Hilfiker et al., U.S. Pat. No. 4,505,621 to Hilfiker et al., U.S. Pat. No. 4,856,939 to Hilfiker, and U.S. Pat. No. 5,722,799 to Hilfiker.

It is also known in the road construction industry that there are various approaches to connecting precast wall panels to grid-type soil reinforcing mats. For example, one such approach is disclosed in U.S. Pat. No. 5,259,704 to Ogorchock. As will become apparent from the following description and discussion, however, the present disclosure sets forth improved connection systems and related methods in comparison to those disclosed in the above-listed disclosures.

SUMMARY OF THE INVENTION

A crimped connection system and methods for use in connection with the construction of earth walls is disclosed. A grid-type soil mat may be provided with a number of crimped ends. The crimped ends may be adapted for engagement through the use of a locking member with another soil mat or with a plurality of anchors partially embedded within a precast concrete panel. The plurality of anchors may be formed as part of a gang or unitary structure to facilitate alignment of the anchors when being cast into the precast concrete panels. Additional details are provided hereinbelow.

In one aspect, the present invention may be a mechanically-stabilized earth wall comprising: at least one precast concrete panel having a plurality of anchors partially embedded therein in generally aligned relationship; and a soil mat having a plurality of longitudinal members and a plurality of transverse members including a forward transverse member resting on top of at least two of the anchors, at least two of the longitudinal members having a crimped end proximate the forward transverse member, each crimped end disposed proximate an anchor and having a downwardly protruding section disposed below the anchor, the anchor and corresponding protruding section defining a space through which a locking member is disposed to engage the crimped end to its corresponding anchor, and at least a portion of the longitudinal member that corresponds to the crimped end disposed above the corresponding anchor. Another feature of this aspect of the invention may be that each crimped end further includes a generally-straight, downwardly-projecting end section disposed in generally parallel relationship with a front face of the at least one precast concrete panel and adjacent thereto. Another feature of this aspect of the invention may be that a lower surface of the forward transverse member is generally co-planar with a lower surface of the longitudinal members. Another feature of this aspect of the invention may be that the plurality of anchors are formed as part of a unitary structure.

In another aspect, the present invention may be a soil mat for use in constructing an earth wall comprising: a plurality of longitudinal members and a plurality of transverse members disposed in the form of a grid, one of the plurality of transverse members being a forward transverse member disposed at a forward end of the grid, at least two of the longitudinal members that have a crimped end proximate the forward transverse member, each crimped end having a protruding section and an intermediate section, the protruding section being disposed in a first direction away from the longitudinal and transverse members, the protruding section being disposed between the intermediate section and the longitudinal member corresponding to the crimped end, the intermediate section being generally parallel to the longitudinal member, the forward transverse member being attached to the intermediate section. Another feature of this aspect of the invention may be that each crimped end further includes a generally-straight end section disposed in generally perpendicular relationship to the intermediate section. Another feature of this aspect of the invention may be that the end section and the protruding section are generally disposed within the same plane. Another feature of this aspect of the invention may be that a lower surface of the forward transverse member is generally co-planar with a lower surface of the longitudinal members. Another feature of this aspect of the invention may further include a second soil mat adapted for engagement with the crimped end, the second soil mail having a plurality of longitudinal and transverse member forming a grid, the crimped ends being disposed adjacent a corresponding longitudinal member of the second soil mat, each protruding section in conjunction with its corresponding longitudinal member of the second soil mat defining a space adapted to be occupied by a locking member when the forward transverse member is in contact with a plurality of the longitudinal members on the second soil mat and when the protruding members are in contact with one of the transverse members on the second soil mat, and when the locking member and the forward transverse member are disposed on opposite sides of the longitudinal members of the second soil mat. Another feature of this aspect of the invention may be that at least a portion of each protruding section is disposed between the locking member and the one of the transverse members on the second soil mat. Another feature of this aspect of the invention may be that the second soil mat includes a flat section and an upstanding section.

Other features, aspects and advantages of the present invention will become apparent from the following discussion and detailed description.

BRIEF DESCRIPTION OF THE DRAWINGS

FIG. 5 is a side view showing the soil mat from FIG. 3 engaged with a precast concrete panel in accordance with a connection system as disclosed and discussed hereinbelow.

FIG. 6 is a top view of the soil mat connected to the precast concrete panel as shown in FIG. 5.

FIG. 10 another perspective view similar to FIG. 9 illustrating the details of a connection system as disclosed and discussed hereinbelow, and more specifically showing an anchor embedded within a precast concrete panel and a soil mat engaged to the anchor with a locking member.

FIG. 11 another perspective view similar to FIGS. 9 and 10 illustrating the details of a connection system as disclosed and discussed hereinbelow, and more specifically showing an anchor embedded within a precast concrete panel and a soil mat engaged to the anchor with a locking member.

FIG. 12 another perspective view similar to FIGS. 9-11 illustrating the details of a connection system as disclosed and discussed hereinbelow, and more specifically showing an anchor embedded within a precast concrete panel and a soil mat engaged to the anchor with a locking member.

While the invention will be described in connection with the preferred embodiments, it will be understood that it is not intended to limit the invention to those embodiments. On the contrary, it is intended to cover all alternatives, modifications, and equivalents as may be included within the spirit and scope of the invention as defined by the appended claims.

DETAILED DESCRIPTION OF THE INVENTION

Figure 1:
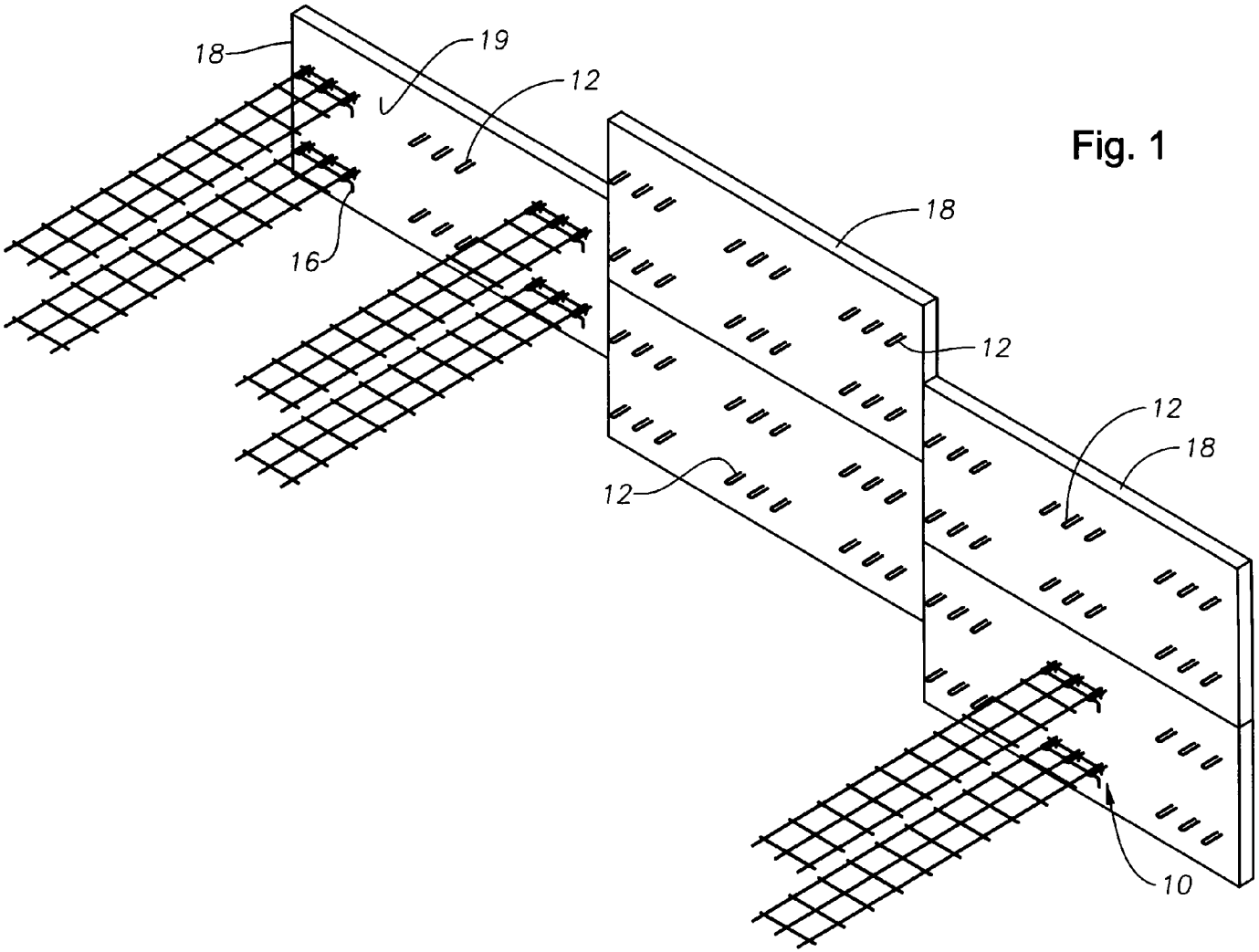
FIG. 1 is a perspective view of a mechanically stabilized earth wall employing a connection system as disclosed and discussed hereinbelow.

Referring to the drawings in detail, wherein like numerals denote identical elements throughout the several views, and referring initially to FIG. 1, there is shown a specific embodiment of a connection system 10 for a mechanically stabilized earth wall. In a specific embodiment, the connection system 10 may include a plurality of anchors 12, a soil mat 14 and a locking rod 16. In FIG. 1, the connection system 10 is shown engaged with a precast reinforced concrete facing panel 18, in which the anchors 12 are embedded.

Figure 2:
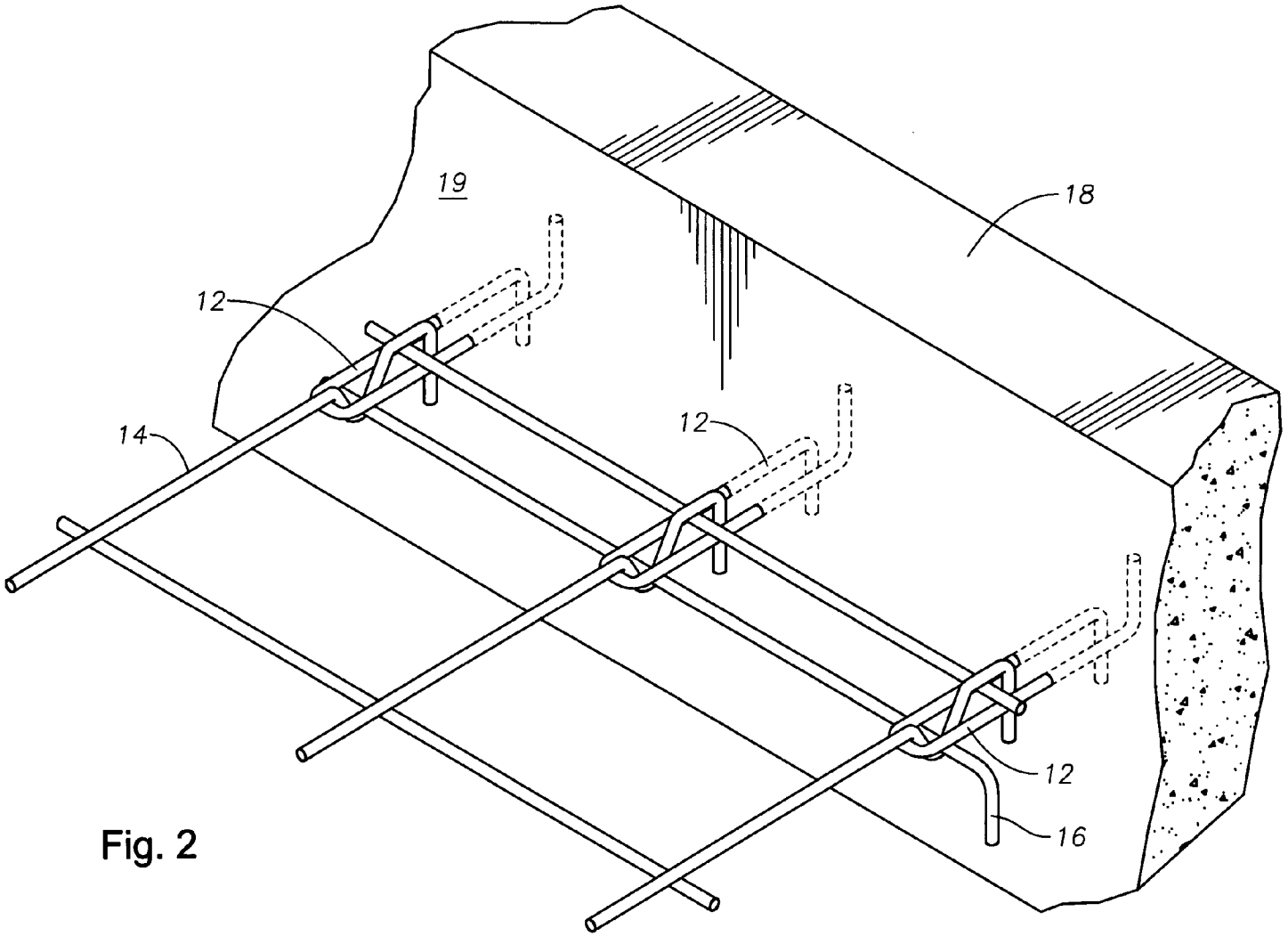
FIG. 2 is an enlarged perspective view similar to FIG. 1 and showing additional details of a connection system as disclosed and discussed hereinbelow.
Figure 7:
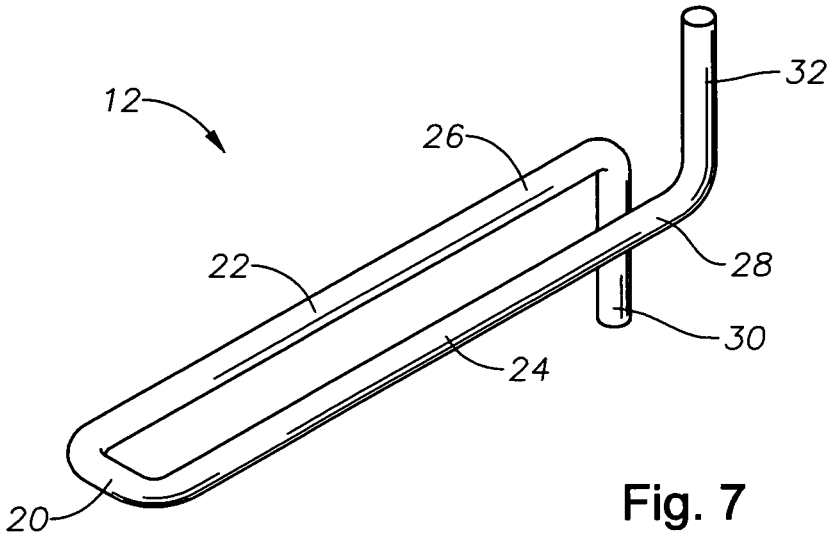
FIG. 7 is a perspective view of a specific embodiment of an anchor for use in accordance with a connection system as disclosed and discussed hereinbelow.
Figure 13:
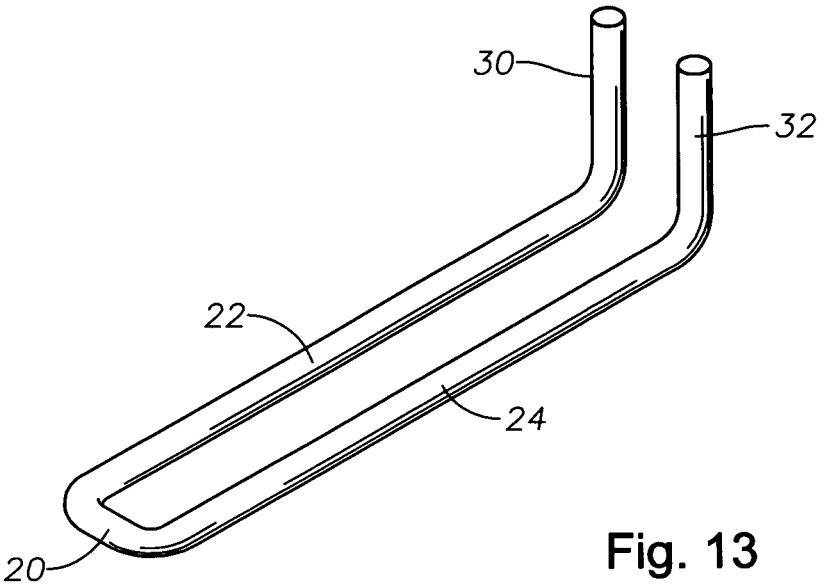
FIG. 13 is a perspective view of another specific embodiment of an anchor, similar to the anchor shown in FIG. 7.
Figure 14:
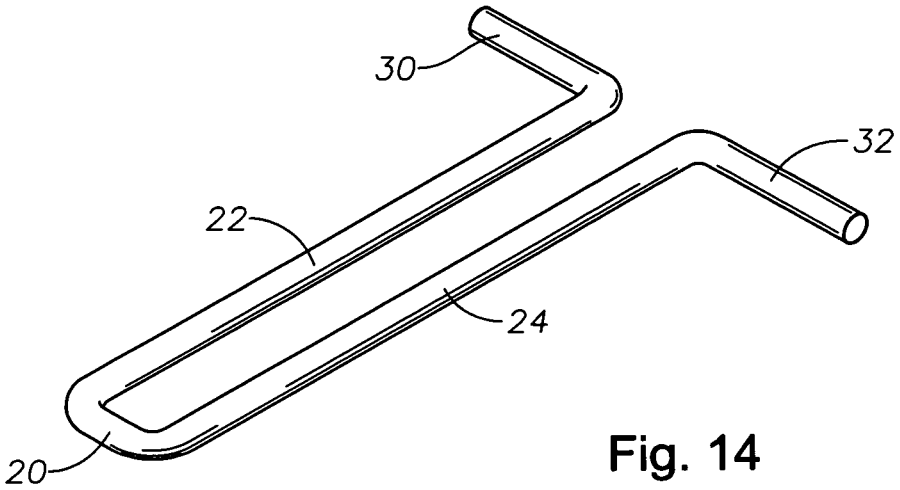
FIG. 14 is a perspective view of yet another specific embodiment of an anchor, similar to the anchors shown in FIGS. 7 and 13.
Figure 15:
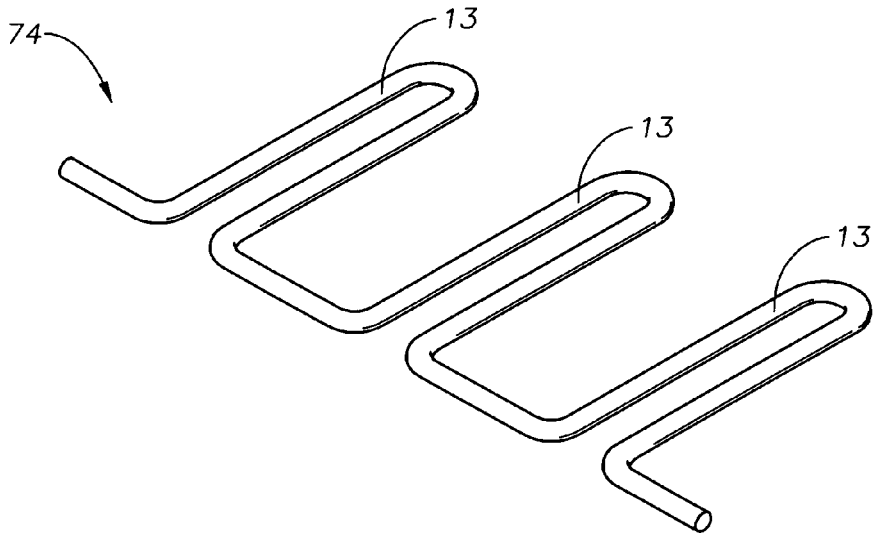
FIG. 15 is a perspective view of a specific embodiment of a unitary or gang structure including three anchors (similar to the anchor shown in FIG. 14) to facilitate anchor alignment when cast into a precast concrete panel.

With reference to FIGS. 2 and 7, in a specific embodiment, each anchor 12 may be constructed from galvanized wire (e.g., W8.2) and include a transverse end member 20 joined with first and second longitudinal members 22 and 24 extending therefrom in generally parallel relationship. The first and second longitudinal members 22 and 24 may include distal ends 26 and 28, respectively, located opposite the transverse end member 20. In a specific embodiment, the distal ends 26 and 28 may further include arms 30 and 32, respectively. In a specific embodiment, as shown in FIGS. 2 and 7, each of the arms 30 and 32 may extend in a generally perpendicular relationship to its corresponding longitudinal member 22/24. In a specific embodiment, the arms 30 and 32 may extend in generally parallel relationship to each other. In a specific embodiment, the arm 30 on the first longitudinal member 22 may extend in a first direction (e.g., downwardly) and the arm 32 on the second longitudinal member 24 may extend in a second, or opposite, direction (e.g., upwardly). In another specific embodiment, as shown in FIG. 13, both of the arms 30 and 32 may extend in the same direction. In another specific embodiment, as shown in FIG. 14, the arms 30 and 32 may extend in opposite directions and generally within the same plane. In another specific embodiment, as shown in FIG. 15, a unitary or gang structure 74 may be provided that include three anchors 13 similar to the anchor shown in FIG. 14. In this manner, each of the three anchors 13 are pre-aligned when cast into the concrete panel 18.

Figure 8:
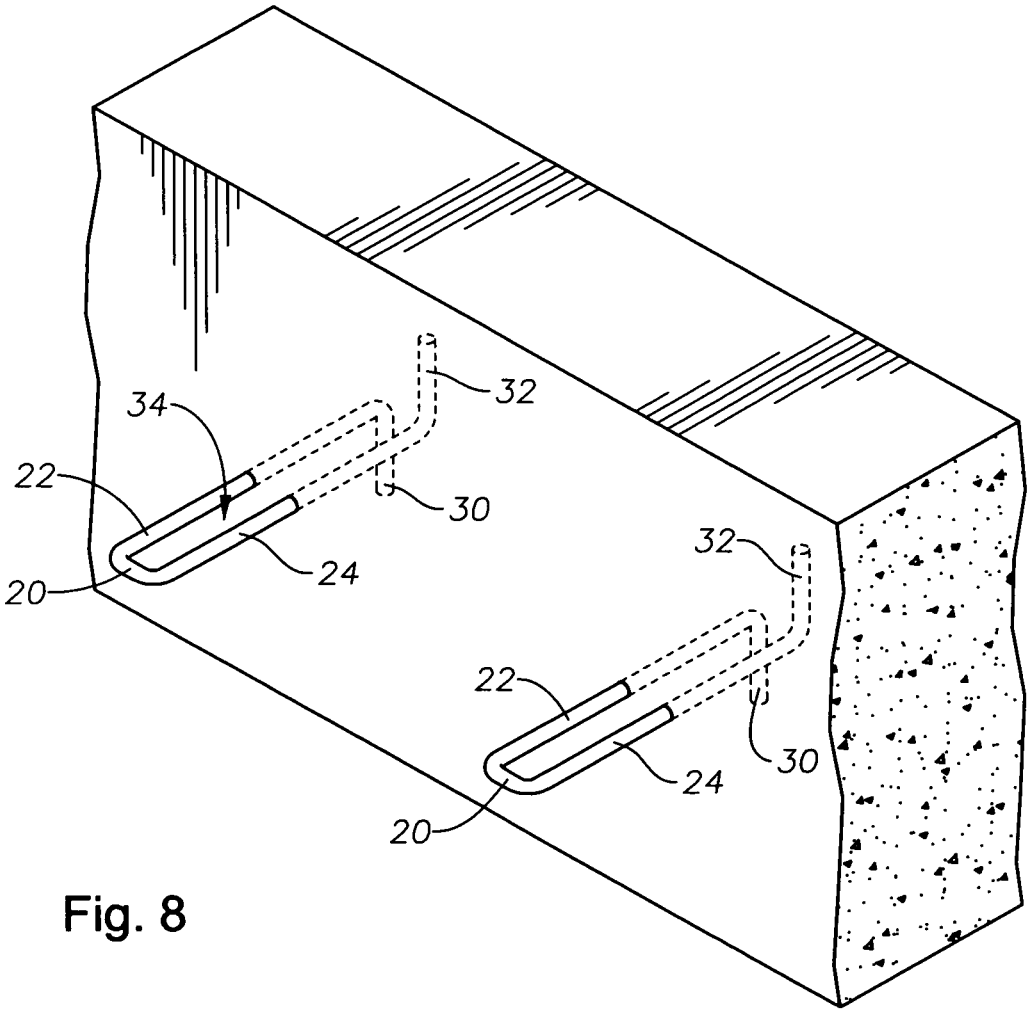
FIG. 8 is a perspective view showing a pair of anchors from FIG. 7 shown embedded within a precast concrete panel.
Figure 9:
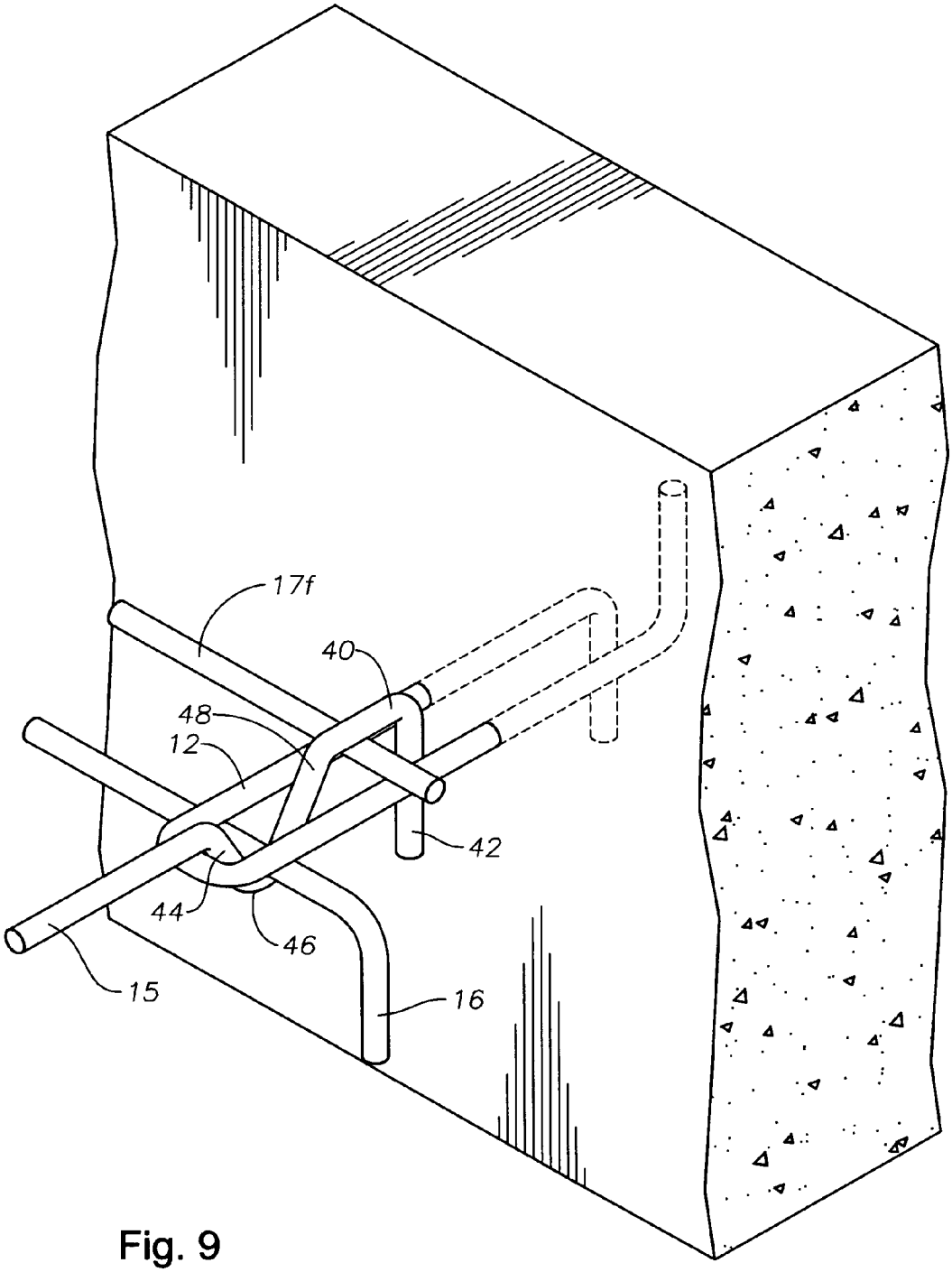
FIG. 9 is a perspective view illustrating the details of a connection system as disclosed and discussed hereinbelow, and more specifically showing an anchor embedded within a precast concrete panel and a soil mat engaged to the anchor with a locking member.

With reference to FIGS. 2, 5 and 8, it can be seen that, when installed, the anchors 12 are partially cast or embedded in the concrete panel 18. More specifically, the distal ends 26 and 28 and the arms 30 and 32 are shown embedded within the concrete panel 18. In a specific embodiment, as shown in FIG. 2, the anchors 12 are shown embedded within the concrete panel 18 such that the longitudinal members 22 and 24 of the anchor 12 are disposed in a generally perpendicular relationship with respect to a front face 19 of the concrete panel 18, and spaced apart for engagement with the soil mat 14, as will be discussed in more detail below. As shown in FIG. 8, when each anchor 12 is embedded within the concrete panel 18, a space 34 is defined within the portion of the anchor 12 extending from the concrete panel 18, the purpose of which will be explained below. The space 34 is defined by the front face 19, the first and second longitudinal members 22 and 24 of the anchor 12, and the transverse end member 20 of the anchor 12. As shown in FIG. 2, in a specific embodiment, a plurality of anchors 12 are embedded within the concrete panel 18 in a generally horizontal aligned relationship and spaced for engagement with the soil mat 14.

Figure 4:
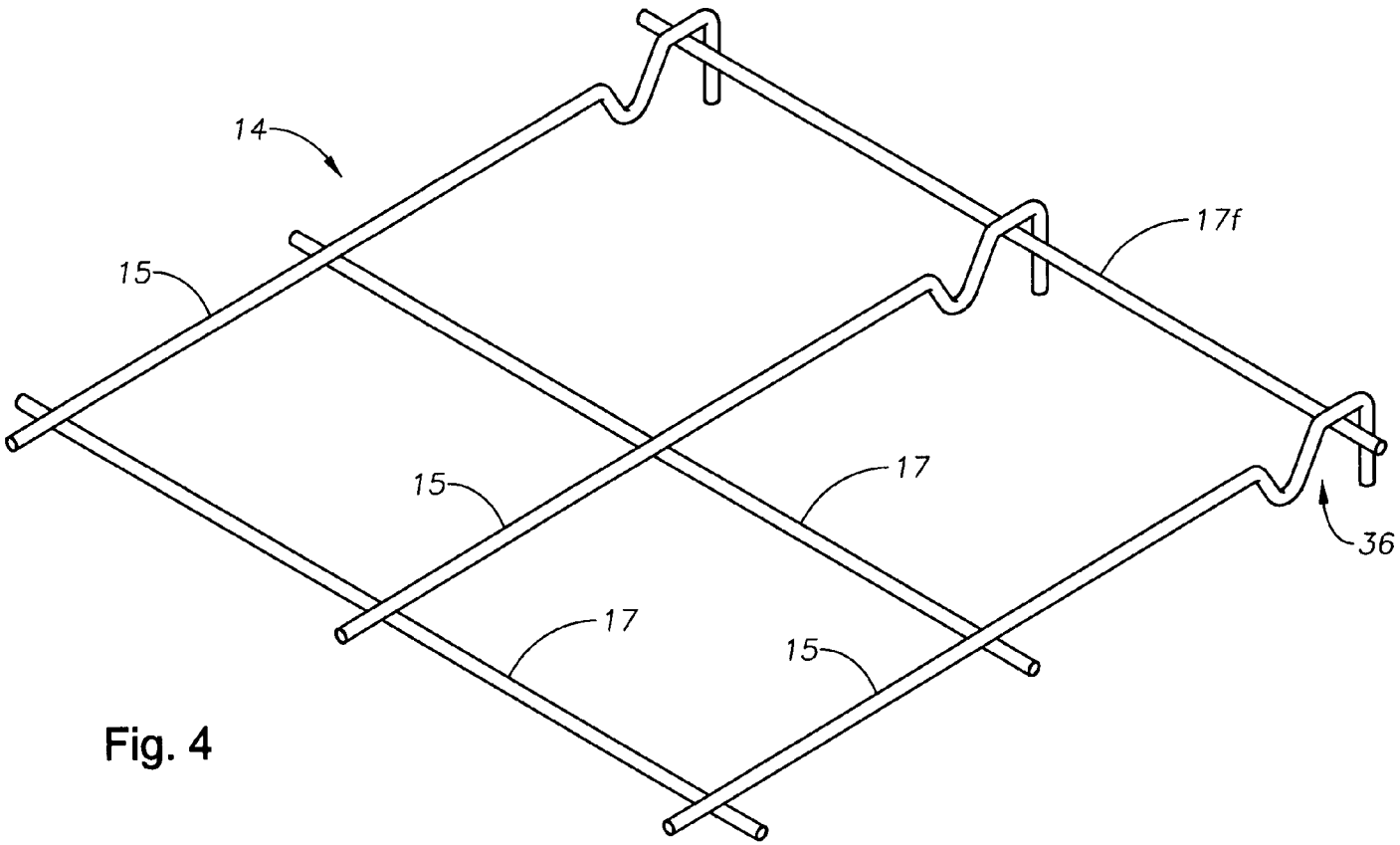
FIG. 4 is a perspective view of the soil mat shown in FIG. 3.

With reference to FIG. 4, in a specific embodiment, the soil mat 14 may be a galvanized, welded-wire, grid-type soil reinforcing mat having a plurality of longitudinal elongated members or wires 15 and a plurality of transverse elongated members or wires 17 and 17*f* disposed in generally perpendicular relationship to the longitudinal members 15. The transverse wire 17*f* is referred to hereinbelow as the forward transverse wire 17*f*. In a specific embodiment, each of the longitudinal members 15 on the soil mat 14 includes a crimped end 36 adapted for engagement with a corresponding anchor 12 in the concrete panel 18 with the assistance of a locking member 16, as will be more fully described hereinbelow. The longitudinal members 15 also include lower surfaces 23, as shown for example in FIG. 5.

Figure 3:
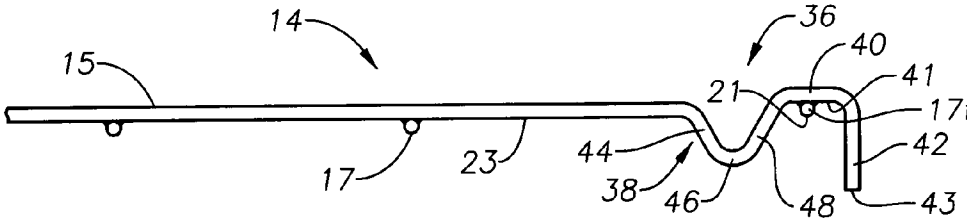
FIG. 3 is a side view of a specific embodiment of a soil mat with a crimped end for use in a connection system as disclosed and discussed hereinbelow.

Referring now to FIG. 3, it can be seen that each crimped end 36 includes a protruding section 38, an intermediate section 40 and an end section 42. In a specific embodiment, the protruding section 38 may include a first leg 44 extending downwardly away from the longitudinal member 15 at an angle relative to the longitudinal member 15. In a specific embodiment, the first leg 44 extends to a bend 46 that leads to a second leg 48, which extends upwardly away from the bend 46 at an opposite angle as the angle of the first leg 44. The second leg 48 extends upwardly to the intermediate section 40, which has a lower surface 41 and is generally parallel to and slightly offset from or raised above its corresponding longitudinal section 15. The forward transverse wire 17*f* is preferably connected to lower surfaces 41 of the intermediate sections 40 and perpendicular to the longitudinal members 15 and intermediate sections 40. The intermediate section 40 is preferably offset from the longitudinal section 15 such that a lower surface 21 of the forward transverse wire 17*f* is generally co-planar with the lower surfaces 23 of the longitudinal members 15. The purpose for this, as shown, for example, in FIG. 5, is so that the longitudinal members 15 and the forward transverse 17*f* will each rest on top of the anchors 12 when the soil mat 14 is engaged with the anchors 12 and in a generally horizontal position as shown in FIG. 5.

Continuing with a description of the crimped ends 36, in a specific embodiment, the intermediate section 40 extends from the second leg 48 of the protruding section 38 to the end section 42 of the crimped end 36. In a specific embodiment, the end section 42 extends downwardly from and is generally perpendicular to the intermediate section 40. When engaged with an anchor 12 as shown for example in FIG. 5, the end section 42 is preferably generally parallel to and abutting the front face 19 of the concrete panel 18. It is believed based on test results that the end section 42 imparts additional strength and stability to the overall connection system 10 when it is subjected to compressive and tensile loads. In a specific embodiment, the end section 42 is preferably sized such that a distal end 43 of the end section 42 is positioned in the same general plane as the bend 46 of the protruding section 38.

Referring now to FIGS. 2 and 5, the manner in which the crimped ends 36 of the soil mat 14 are engaged with the anchors 12 will now be described. First, the soil mat 14 is positioned relative to the anchors 12 so that the crimped ends 36 are lowered into the spaces 34 defined by the anchors 12 (see FIG. 8) until the lower surfaces 23 of the longitudinal wires 15 and the lower surface 21 (FIG. 3) of the forward transverse wire 17*f* are resting on top of the anchors 12. When in this position, each protruding section 38 of the crimped ends 36 will extend downwardly through the corresponding space 34 of its corresponding anchor 12 and below its corresponding anchor 12 so as to form a locking rod space 50 (see FIG. 5) bounded by the protruding section 38 and the bottom of the anchor 12. The locking member 16 is then passed through each of the locking rod spaces 50, thereby engaging the soil mat 14 to the anchors 12 and thus to the precast concrete panel 18. When tension is applied by imparting a pulling force to the soil mat 14 away from the concrete wall 18, the soil mat 14 is securely engaged to the anchors 12 by virtue of the locking member 16 bearing against and trapped between the protruding member 36 and the anchor 12. The forward transverse member 17*f* will bear against the top of the anchors 12 to prevent the crimped ends 36 from dropping down and removing the ability of the second leg 48 of the protruding member 36 to assist in trapping the locking member 16 in the locking rod space 50.

The connection system 10 as described above may also be used in joining or splicing together two structures or components other than connecting a soil mat 14 to an anchor 12 embedded in a precast concrete panel 18.

Figure 16:
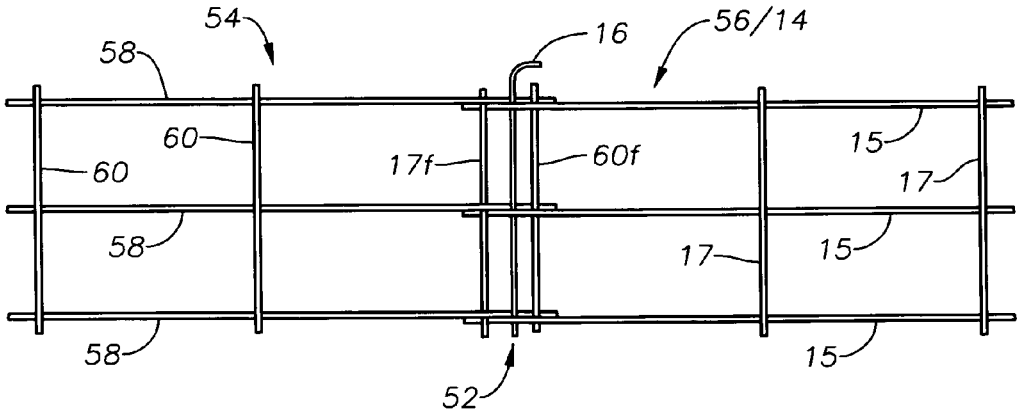
FIG. 16 is a top view showing a connection system for joining two soils mats.
Figure 17:
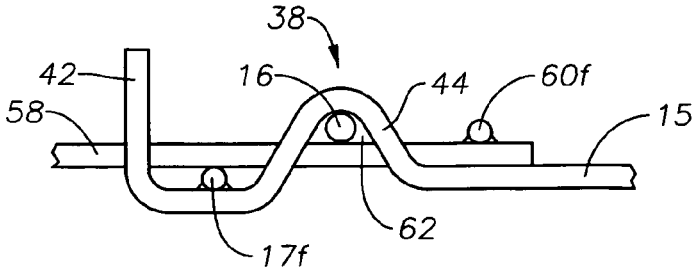
FIG. 17 is an exploded side view showing the details of the connection system shown in FIG. 15.

For example, referring now to FIGS. 16 and 17, a connection system 52 is shown for joining or splicing together two soils mats, namely, a first soil mat 54 and a second soil mat 56. In a specific embodiment, the first soil mat 54 may be a standard soil mat of standard configuration as used in the road construction industry, and the second soil mat 56 may be a soil mat 14 having crimped ends 36 as described and illustrated above. In this specific embodiment, instead of connecting the soil mat 14 to an anchor 12 as discussed above, the crimped ends 36 of the soil mat 14 are engaged through the use of the locking member 16 to the first soil mat 54. The first soil mat 54 may be a standard, galvanized, welded-wire, grid-type reinforcing mat having a plurality of longitudinal members 58 and a plurality of transverse members 60 welded together with the longitudinal members 58 disposed in generally perpendicular fashion to the transverse members 60 to form a grid. The transverse member 60*f* is referred to herein as the forward transverse member 60*f* of the first soil mat 54. With reference to FIG. 17, an illustration is provided of the manner in which the crimped ends 36 of the second soil mat 56/14 are connected to the first soil mat 54. In a specific embodiment, as shown in FIG. 17, the second soil mat 56/14 may be positioned on the ground with the protruding section 38 and the end section 42 pointing upwardly. The first mat 54 may then be positioned in overlapping fashion with respect to the second mat 56/14 such that the longitudinal members 58 on the first mat 54 are generally above, aligned with and abutting corresponding longitudinal members 15 on the second mat 56/14. The forward transverse members 17*f* and 60*f* on the second soil mat 56/14 and first soil mat 54, respectively, are positioned such that the protruding sections 38 of each crimped end 36 are disposed between the forward transverse members 17*f* and 60*f*, with the longitudinal members 58 of the first soil mat 54 resting on top of the forward transverse member 17*f*. When in this position, a locking rod space 62 is formed between the protruding sections 38 of the crimped ends 36 and the longitudinal members 58 of the first mat 54. When the locking member 16 is inserted through the locking rod spaces 62, the first soil mat 54 is thereby connected to the second soil mat 56 to form a soil mat splice. When the second soil mat 56/14 is pulled away from the first soil mat 54 after this connection is made, the first leg 44 of the protruding section 38 will bear against the forward transverse member 60*f* on the first mat 54, the protruding section 38 will downwardly force the locking member 16 against the top of the longitudinal members 58 on the first mat 56, and the forward transverse member 17*f* on the second soil mat 56/14 will be forced upwardly against the bottom of the longitudinal members 58 on the first mat 56, thereby securely engaging the first mat 56 with the second mat 56/14.

Figure 18:
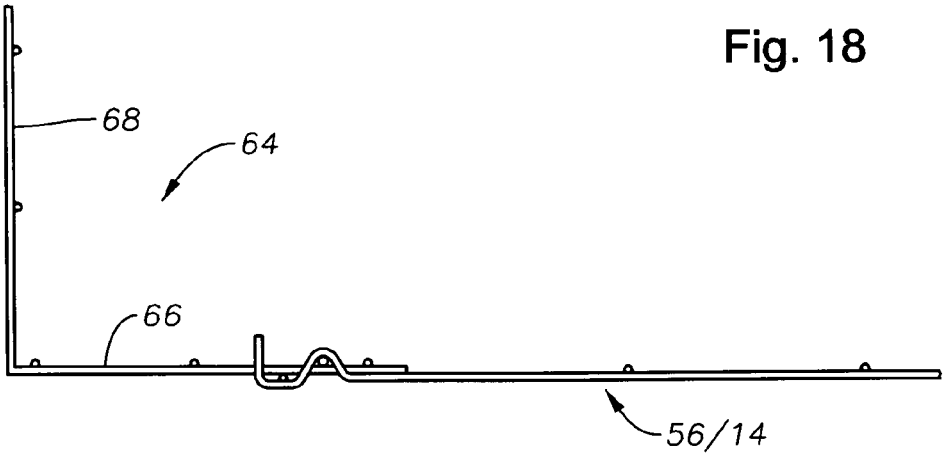
FIG. 18 is a side view illustrating a connection system for joining a flat soil mat to an L-shaped soil mat for use in constructing temporary welded-wire earth walls
Figure 19:
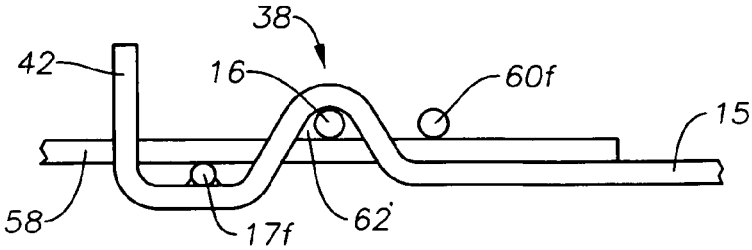
FIG. 19 is an exploded side view showing the details of the connection system shown in FIG. 18.

Referring now to FIGS. 18 and 19, another example of how a connection system as disclosed herein may be used to connect two structures is illustrated. This example is similar to the one discussed above and shown in FIGS. 16 and 17, except that instead of connecting the second mat 56/14 to another soil mat, it is connected to an L-shaped wirewall face section 64 of the type for use in constructing a temporary welded-wire earth wall. The face section 64 may include a generally horizontal section 66 and an upstanding section 68. In a specific embodiment, the horizontal section 66 of the L-shaped face section 64 has the same configuration of the first soil mat 56 as explained above and described in connection with FIGS. 16 and 17. Accordingly, the manner in which the second soil mat 56/14 is connected to the horizontal section 66 of the L-shaped face section 64 is the same as described above with respect to the manner in which the second soil mat 56/14 is connected to the first soil mat 54.

It is to be understood that the invention is not limited to the exact details of construction, operation, exact materials or embodiments shown and described, as obvious modifications and equivalents will be apparent to one skilled in the art. It is further noted that the phrases downwardly and upwardly have been used herein for purposes of providing a frame of reference only; those phrases should not be taken as limitations. For example, inverting those directions, for example, by describing the soil mat 14 in an inverted position, with the protruding section 38 pointing up instead of down, should not be taken as a limitation. Accordingly, the invention is therefore to be limited only by the scope of the appended claims.

The invention claimed is:

1. A mechanically-stabilized earth wall comprising:

at least one precast concrete panel having a plurality of anchors partially embedded therein in generally aligned relationship; and a soil mat having a plurality of longitudinal members and a plurality of transverse members including a forward transverse member resting on top of at least two of the anchors, at least two of the longitudinal members having a crimped end proximate the forward transverse member, each crimped end disposed proximate an anchor and having a downwardly protruding section disposed below the anchor, the anchor and corresponding protruding section defining a space through which a locking member is disposed to engage the crimped end to its corresponding anchor, and at least a portion of the longitudinal member that corresponds to the crimped end disposed above the corresponding anchor, each crimped end further including a generally-straight, downwardly-projecting end section disposed in generally parallel relationship with a front face of the at least one precast concrete panel and adjacent thereto.

2. The mechanically-stabilized earth wall of claim 1, wherein a lower surface of the forward transverse member is generally co-planar with a lower surface of the longitudinal members.

3. The mechanically-stabilized earth wall of claim 1, wherein the plurality of anchors are formed as part of a unitary structure.

4. A soil mat for use in constructing an earth wall comprising:

a plurality of longitudinal members and a plurality of transverse members disposed in the form of a grid, one of the plurality of transverse members being a forward transverse member disposed at a forward end of the grid, at least two of the longitudinal members having a crimped end proximate the forward transverse member, each crimped end having a protruding section and an intermediate section, the protruding section being disposed in a first direction away from the longitudinal and transverse members, the protruding section being disposed between the intermediate section and the longitudinal member corresponding to the crimped end, the intermediate section being generally parallel to the longitudinal member, the forward transverse member being attached to the intermediate section, each crimped end further including a generally-straight end section disposed in generally perpendicular relationship to the intermediate section, the crimped end being adapted for engagement with an anchor protruding from a front face of a precast concrete panel with the generally-straight end section being disposed in generally parallel and abutting relationship with the front face of the concrete panel.

5. The soil mat of claim 4, wherein the end section and the protruding section are generally disposed within the same plane.

6. The soil mat of claim 4, wherein a lower surface of the forward transverse member is generally co-planar with a lower surface of the longitudinal members.

7. The soil mat of claim 4, further including a second soil mat adapted for engagement with the crimped end, the second soil mail having a plurality of longitudinal and transverse member forming a grid, the crimped ends being disposed adjacent a corresponding longitudinal member of the second soil mat, each protruding section in conjunction with its corresponding longitudinal member of the second soil mat defining a space adapted to be occupied by a locking member when the forward transverse member is in contact with a plurality of the longitudinal members on the second soil mat and when the protruding members are in contact with one of the transverse members on the second soil mat, and when the locking member and the forward transverse member are disposed on opposite sides of the longitudinal members of the second soil mat.

8. The soil mat of claim 7, wherein at least a portion of each protruding section is disposed between the locking member and the one of the transverse members on the second soil mat.

9. The soil mat of claim 7, wherein the second soil mat includes a flat section and an upstanding section.

* * * * *